US009402476B2

(12) United States Patent
Crandall

(10) Patent No.: US 9,402,476 B2
(45) Date of Patent: Aug. 2, 2016

(54) SHOWER SHELF

(71) Applicant: Brian Crandall, Idaho Falls, ID (US)

(72) Inventor: Brian Crandall, Idaho Falls, ID (US)

( * ) Notice: Subject to any disclaimer, the term of this patent is extended or adjusted under 35 U.S.C. 154(b) by 0 days.

(21) Appl. No.: 14/507,508

(22) Filed: Oct. 6, 2014

(65) Prior Publication Data

US 2016/0095437 A1 Apr. 7, 2016

(51) Int. Cl.

*A47B 96/02* (2006.01)
*A47B 96/06* (2006.01)
*A47K 3/28* (2006.01)

(52) U.S. Cl.

CPC ..... *A47B 96/022* (2013.01); *A47B 96/021* (2013.01); *A47B 96/024* (2013.01); *A47K 3/281* (2013.01)

(58) Field of Classification Search

CPC .... A47B 47/022; A47B 57/045; A47B 57/56; A47B 57/562; A47B 57/565; A47B 57/567; A47B 96/02; A47B 96/021; A47B 96/022; A47B 96/024; A47B 96/027; A47B 96/028; A47B 96/06; A47B 96/061; A47B 96/066; A47B 96/067; A47K 3/281

USPC ..... 211/90.01

See application file for complete search history.

(56) References Cited

U.S. PATENT DOCUMENTS 483,069 A * 9/1892 Legg ..... A47B 96/02 108/42
682,192 A * 9/1901 Hazen ..... A47B 96/022 248/220.1
814,811 A * 3/1906 Speed ..... F16B 15/04 108/42
975,619 A * 11/1910 Hollander ..... A47B 96/02 108/42
1,222,762 A * 4/1917 Houghton ..... A47B 96/022 248/220.1
1,286,588 A * 12/1918 Goodykoontz ..... F16M 13/02 108/28
1,325,143 A * 12/1919 Conterio ..... F16M 13/02 108/152
1,599,654 A * 9/1926 Cranston ..... A47B 96/022 211/153
2,465,635 A * 3/1949 Conterio ..... A47B 96/022 108/42
4,555,082 A * 11/1985 Sack ..... A47B 96/022 108/42
4,708,310 A 11/1987 Smith
4,886,236 A * 12/1989 Randall ..... A47B 96/022 108/152
D313,720 S * 1/1991 Sorenson ..... D6/562
5,513,575 A * 5/1996 Slade ..... A47B 96/02 108/42
5,992,654 A 11/1999 Dente
6,052,845 A 4/2000 Harvey
6,301,725 B1 10/2001 Harvey
6,467,636 B1 10/2002 Schaefer
6,591,762 B1 7/2003 Haghayegh
6,619,488 B2 9/2003 Bengoechea
7,621,223 B2 11/2009 Haghayegh
7,802,766 B2 9/2010 Thompson
7,987,535 B1 8/2011 Tesch
8,020,820 B2 9/2011 Thompson
8,042,700 B1 10/2011 Smalley (Continued)

FOREIGN PATENT DOCUMENTS

GB 2109672 A * 6/1983 ..... A47B 96/022
WO WO 9302594 A1 2/1993

*Primary Examiner* — Joshua Rodden
(74) *Attorney, Agent, or Firm* — Scott D. Swanson; Shaver & Swanson, LLP

(57) ABSTRACT

What is disclosed is a shelf system and method of installing the shelf system. In a preferred embodiment the shelf has a first piece and a second piece. The first piece is a shelf and the second piece attaches to a corner. The shelf and second piece are connectable in a mortise and tenon arrangement.

20 Claims, 13 Drawing Sheets

(56) References Cited

U.S. PATENT DOCUMENTS 8,225,435 B2 * 7/2012 Kik, Jr. ..... A47K 3/282
248/220.1
8,998,008 B1 * 4/2015 Robertson ..... A47B 96/022
108/42
2008/0224004 A1 * 9/2008 Gallien ..... A47B 96/066
248/220.1
2009/0183306 A1 7/2009 Kik, Jr. et al.
2013/0264447 A1 * 10/2013 Baruch ..... A47B 96/022
248/235

* cited by examiner

SHOWER SHELF

TECHNICAL FIELD

The present invention relates to a kit and method for installing a shower shelf into a shower. The kit and method work to install a shower shelf system, after the shower has been built and tiled or while the shower is being tiled. The kit includes parts connected via a tenon and mortise system, also potentially called a rail and channel system. The method and kit may be useful, for example, in the field of construction, renovation, maintenance, repair, furnishing, home improvement, and in Do it Yourself (DIY) applications.

BACKGROUND OF THE INVENTION

In the fields of construction, bathroom updating, and tiling there is often a need to install shower support structures, or shelf, on which a person taking a shower or bath can place items such as shampoo, soap, or other personal hygienic items.

Shower shelves are often installed when a shower is being constructed. However, these shower shelves can often be laborious to install. The shower shelf may break or a home owner may desire to update their bathroom and install a new shower shelf. It can be difficult for a DIYer to easily replace the shelf and/or to make the shelf appear as though a professional has installed it. What is needed is a system by which a professional or a DIYer can easily install a shower shelf either while the person is originally tiling a shower or after the shower has already been installed, as the shelf as an aftermarket product.

SUMMARY OF THE DISCLOSURE

The purpose of the Summary is to enable the public, and especially the scientists, engineers, and practitioners in the art who are not familiar with patent or legal terms or phraseology, to determine quickly from a cursory inspection, the nature and essence of the technical disclosure of the application. The Summary is neither intended to define the inventive concept (s) of the application, which is measured by the claims, nor is it intended to be limiting as to the scope of the inventive concept(s) in any way.

What is disclosed is a kit having a series of parts for installing a shelf into a shower. The kit has a first piece and a second piece. The first piece is a shelf for installing in a shower (or other location having a corner). The first piece and the second piece are configured to connect via a mortise and tenon configuration. The second piece is configured to attach to a wall, preferably by an adhesive.

The kit in includes a jig by which a user guides the second piece into attachment with the shower wall. The jig, in a preferred embodiment, has an opening slightly larger than said second piece such that said second piece is capable of passing though said jig. The jig has two sections configured in a corner shape. The jig is configured to fold generally along an axis such that the jig can fold thus increasing or decreasing the angle between the two sections of the jig such that the jig can fit into corners. This allows the jig to be placed into a square corner, or to be folded (or bent) inward or outward to compensate for corners that are not square. The jig can be made to be removably attached to a shower corner (such as by an adhesive or a double sided tape). This allows an installer/user to position the jig and have it stay in position with a "hands free" operation.

The jig and said second piece are configured such that when said jig is placed in a corner, the opening(s) of the jig is configured to position the second piece through the opening. This guides the second piece into proper location on the wall such that when the shelf is attached to the second piece(s) the shelf is located level in the corner and in proper position to be permanently attached to the second piece and to function as a corner. The second piece can be multiple tenons that are installed on adjacent walls of the shower or the tenon (or mortise in an alternate embodiment) can be a single piece.

The kit can be made such that either the first piece or the second piece include or are a tenon, whereas the second piece can be the mortise. When the second piece is configured as the tenon, the jig is configured such that when said jig is placed in a corner, the opening(s) of the jig is aligned such that the tenon (or first piece) is guided by an installer through the opening of the jig and positioned on the corner of the wall of a shower such that when said shelf is attached to said mortise said shelf is in a generally horizontal position. In a preferred embodiment, the kit includes an adhesive for attaching the second piece to a wall and/or an adhesive for attaching the first piece to the second piece.

It is thought that the invention can be useful in installing a variety of shelves made of a variety of materials. These materials can include stone, such as granite or marble, or the shelf can be made to be tiled to match the remainder of a tiled shower.

A method of using the kit and/or in installing a shower shelf (or other shelf) is also disclosed. The method, in a preferred embodiment, includes providing a shelf having a mortise on two adjacent edges. A second piece is provided that has a tenon that fits in the mortise. A jig is also provided that has an opening approximately the size of the tenon such that the tenon can pass through the opening of the jig. The opening in the jig is located such that when the jig is positioned in a corner of a wall, the opening is aligned such that the tenon is positioned such that when said shelf is attached to said tenon said shelf is in a generally level and useable position.

A user locates the jig on a wall corner such that the jig is flush with said wall corner. The user then attaches the tenon (or first piece in this embodiment) to the shower corner by passing the tenon through the opening in the jig and attaching the first piece to the corner. The user the removes the jig and attaches the shelf to the first piece by connecting the edge and mortise of the shelf to the tenon.

An alternate method of installing a shower shelf is also disclosed. The method includes the step of providing a shelf having a tenon on adjacent edges and a second piece having a mortise. The tenon of the shelf is configured to mate with the mortise of the second piece. A jig is provided for aligning the second piece in proper position in a corner of, for example, a shower. The jig has at least one opening approximately the size of the second piece such that the second piece can pass through the opening. The opening is located such that when the jig is positioned in a corner of a wall the opening is aligned such that when a user positions the second piece through the opening and adheres the second piece(s) to a wall the second piece(s) is aligned such that when a shelf is attached to the second piece(s) the shelf is installed at a generally level and useable position.

The method includes the step of locating the jig on a wall corner such that the jig is flush with the wall corner. The user then attaches the second piece to the corner by passing the second piece through the opening in the jig and attaching the second piece to the corner. The jig locates the second piece in the correct position on the corner in order to properly mount the shelf to the second piece(s). The second piece is preferably mounted to the corner using an adhesive that is durable to the environment of a shower or other bathing area. After a user mounts the second piece(s), the user removes the jig.

The user attaches the shelf to the second piece by connecting the edge(s) of the shelf having a tenon(s) with the mortise of the second piece. Preferably the tenon of the first piece is attached to the mortise of the second piece by an adhesive.

While it is disclosed that preferred embodiments of the shower shelf system are directed toward installing in a shower, the system can be installed in any area that is in need of a shelf. This could include, for example, a closet, a shower, a steam room, a sauna, a kitchen, and a wide variety of other areas.

Still other features and advantages of the presently disclosed and claimed inventive concept(s) will become readily apparent to those skilled in this art from the following detailed description describing preferred embodiments of the inventive concept(s), simply by way of illustration of the best mode contemplated by carrying out the inventive concept(s). As will be realized, the inventive concept(s) is capable of modification in various obvious respects all without departing from the inventive concept(s). Accordingly, the drawings and description of the preferred embodiments are to be regarded as illustrative in nature, and not as restrictive in nature.

DETAILED DESCRIPTION OF THE EXEMPLARY EMBODIMENTS

Figure 1:
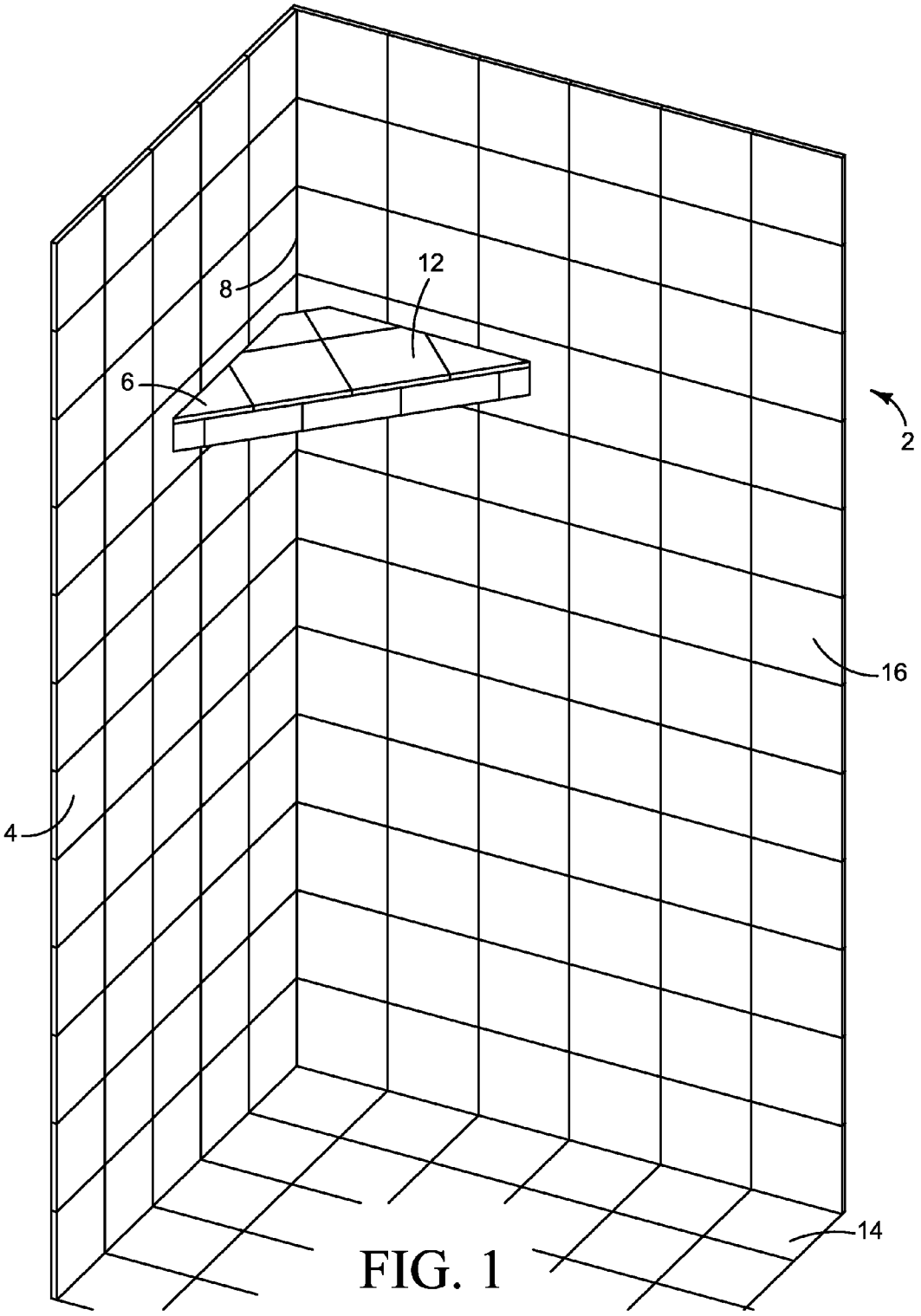
FIG. 1 illustrates a perspective view of a shower with an embodiment of the invention installed in the shower.

While the presently disclosed inventive concept(s) is susceptible of various modifications and alternative constructions, certain illustrated embodiments thereof have been shown in the drawings and will be described below in detail. It should be understood, however, that there is no intention to limit the inventive concept(s) to the specific form disclosed, but, on the contrary, the presently disclosed and claimed inventive concept(s) is to cover all modifications, alternative constructions, and equivalents falling within the spirit and scope of the inventive concept(s) as defined in the claims.

In various embodiments, the present invention is directed to a kit of parts the user may purchase as a single system, or as individual parts and assemble into a shower shelf or other shelving unit as well as to a method(s) of installing a shower shelf (or similar shelf) in a corner of the shower (or other corner or a house). The shower shelf can come in a variety of materials, including a base or skeleton unit that can be tiled by an installer or as a piece of rock such as marble or granite that has been routed to have a mortise or a tenon along its edge. In a preferred embodiment a tenon fits in the mortise such that adhesive can be placed in the mortise or on the tenon and the mortise aspect of the apparatus attached to the tenon on the wall. Alternatively, a tenon or jig can be placed into as a unit and attached to a wall, and the shelf having a mortise is then attached to the groove via adhesive.

FIG. 1 illustrates a shower 2 having a shelf attached. The shower has a floor 14 and adjacent walls, 16, 4 that connect at a corner 8. Shower shelf 6 is attached between the two walls at corner 8. The shower shelf depicted in this embodiment is finished with tile 12.

Figure 2:
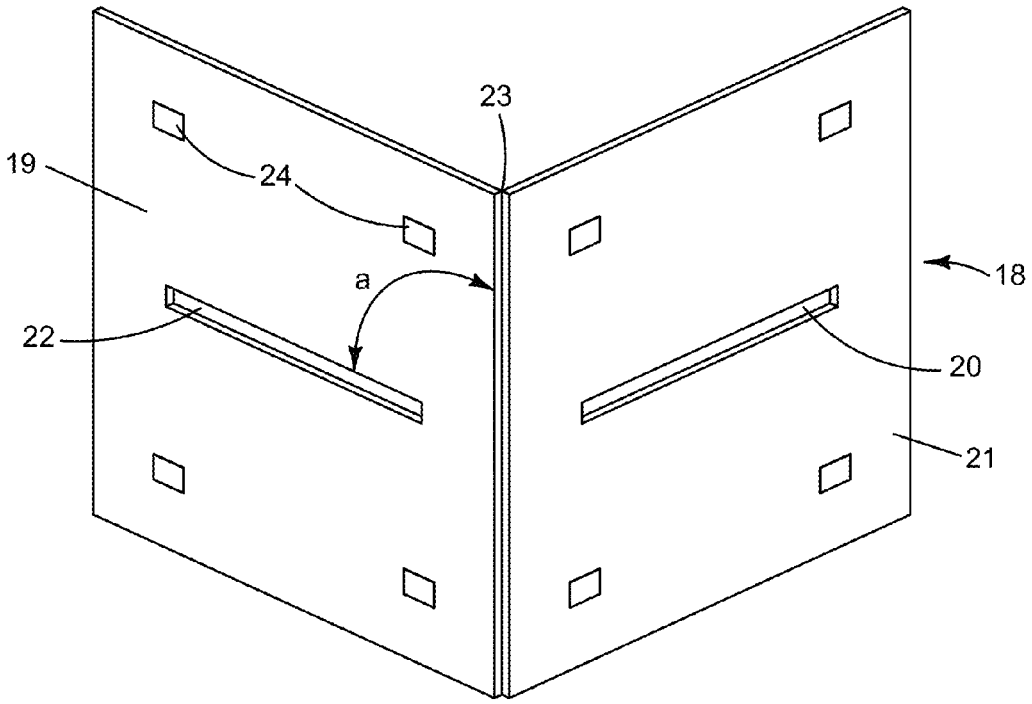
FIG. 2 illustrates a perspective view of an embodiment of a jig used in embodiments of the present invention.
Figure 3:
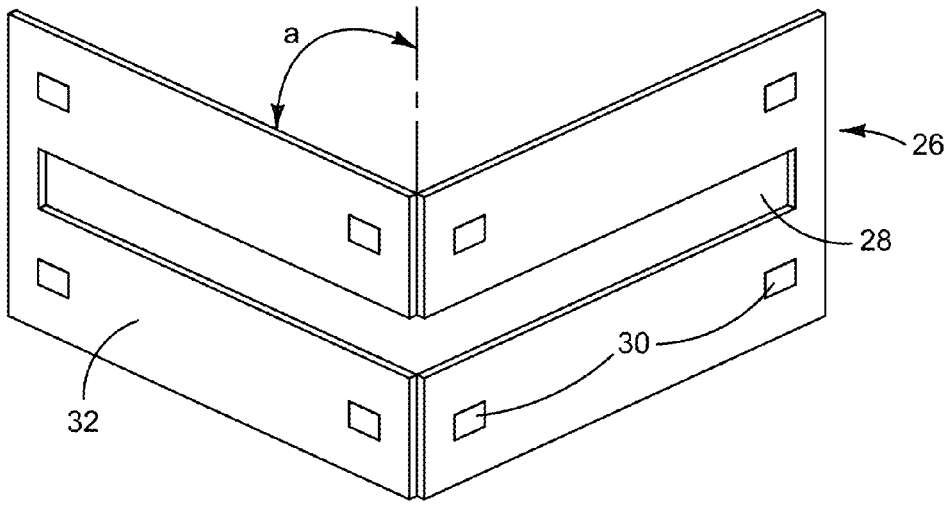
FIG. 3 illustrates a perspective view of an embodiment of a jig used in embodiments of the present invention.

FIGS. 2 and 3 illustrate embodiments of jigs for use in installing shower shelf embodiments disclosed herein. In FIG. 2, jig 18 has elongated openings 20, 22 into which a tenon is located when attaching the tenon to a corner. The jig 18 is foldable along the center line 23 such that the jig 18 fits into the corner of a shower or other room. The jig is adjustable in angle as illustrated by line a. This allows the angle of the fold of the jig to be increased or decreased to compensate for shower corners that are not perfectly square. Conceivably a different width shower shelf could be provided for non-traditional shower angles.

Figure 7:
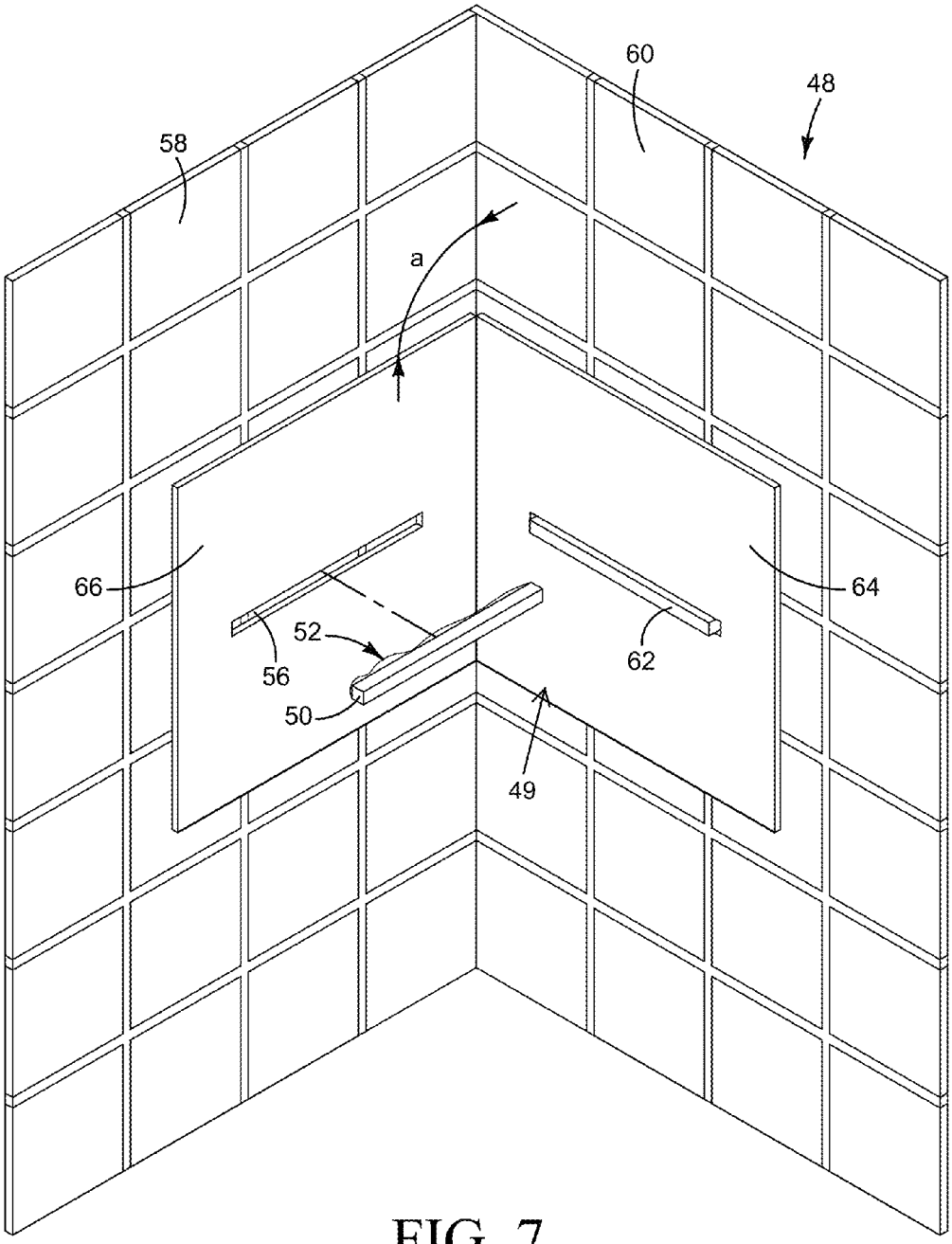
FIG. 7 illustrates a perspective view of a step in a method of installing a shower shelf according to embodiments of the present invention.
Figure 8:
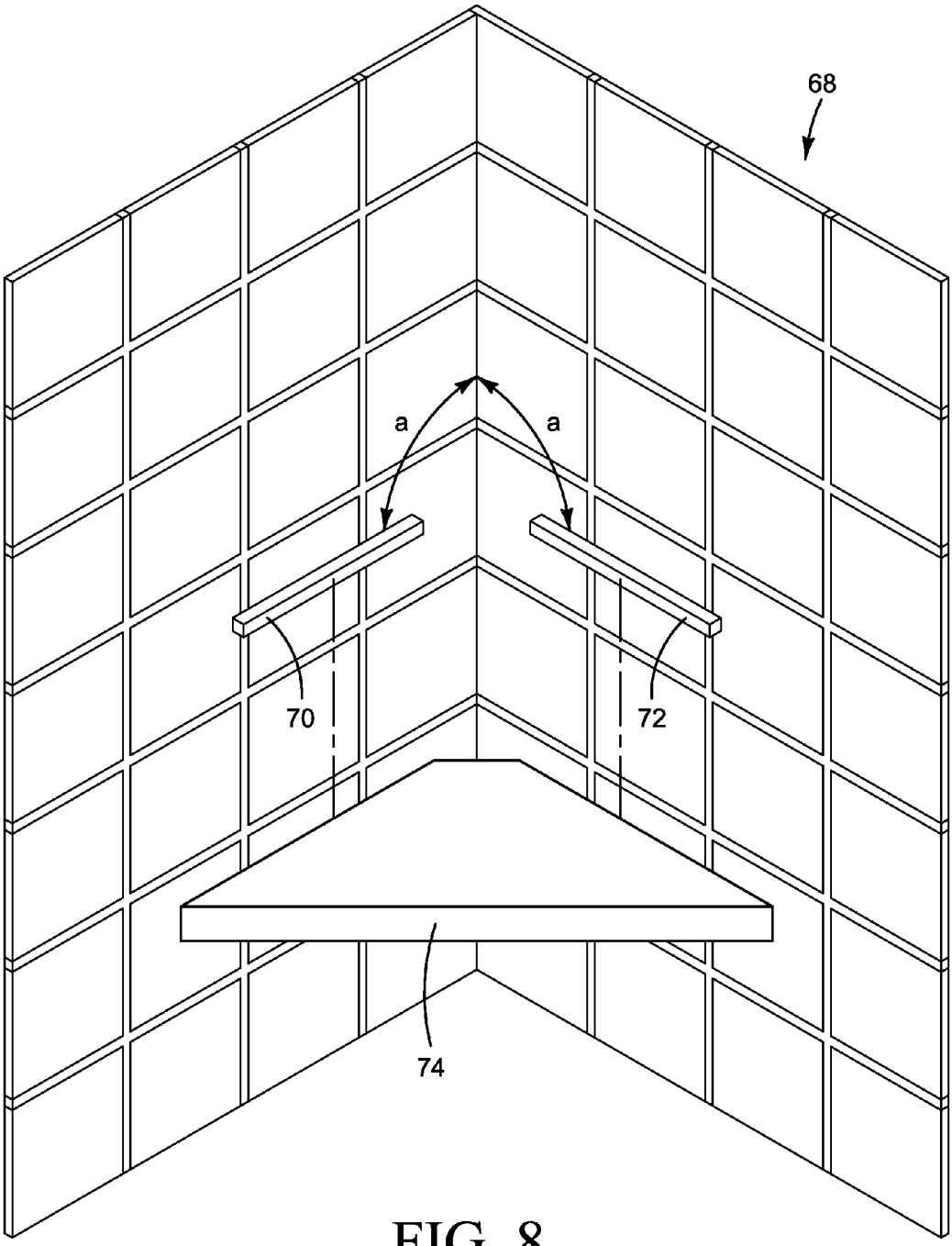
FIG. 8 illustrates a perspective view of a step in a method of installing a shower shelf according to embodiments of the present invention.
Figure 9:
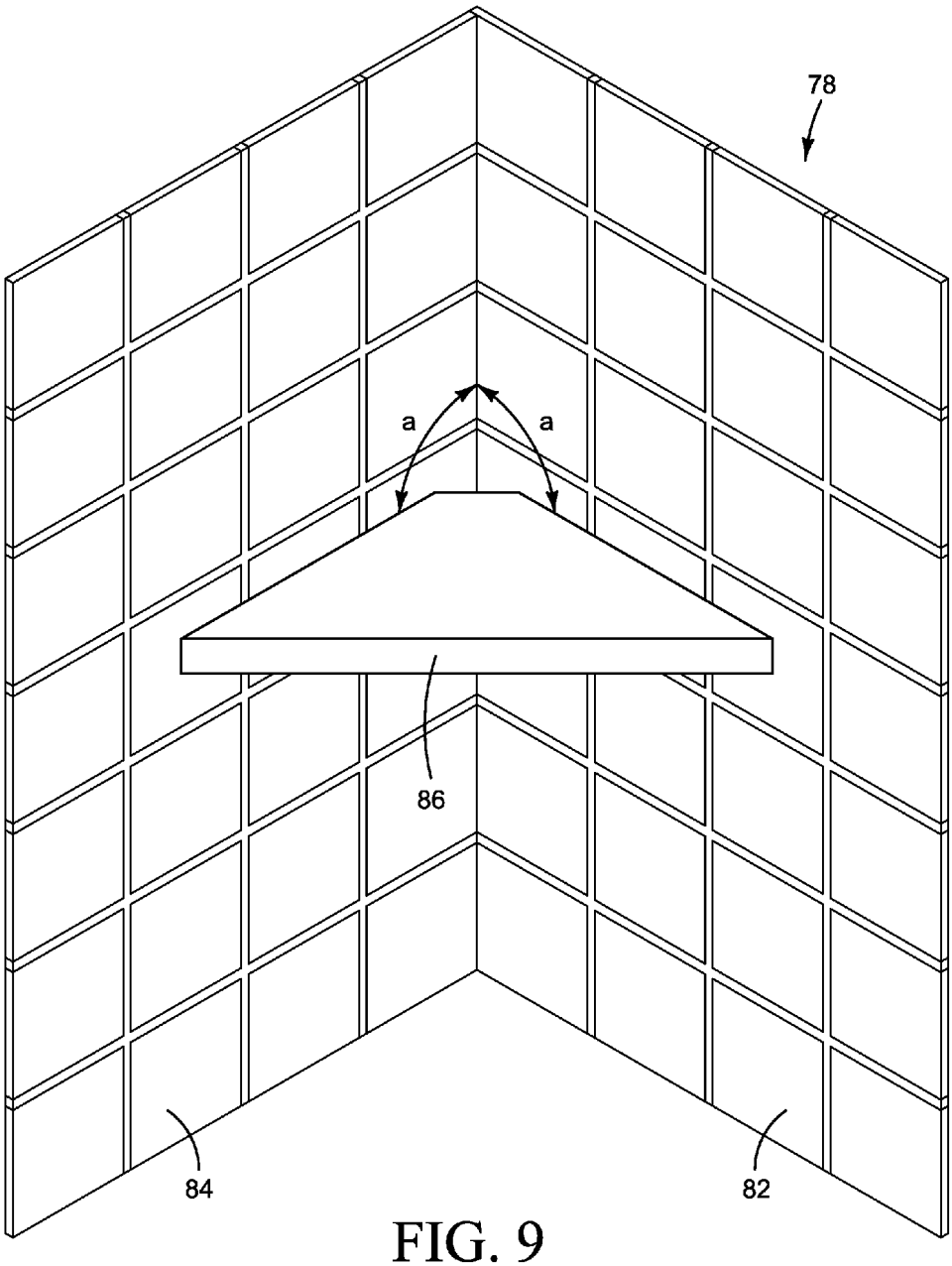
FIG. 9 illustrates a perspective view of a step in a method of installing a shower shelf according to embodiments of the present invention.

When the jig is aligned properly in the corner with adjacent sides 19, 21 of the jig adhered (via connectors 24) or placed against adjacent walls of a corner the elongate openings 20, 22 are aligned such that tenons positioned on the wall and guided by the openings are positioned such that a shelf with one or two mortises aligns with the tenons to form an aligned shelf (see FIGS. 7-9). The jig 18 is removably attaches to the wall by connectors 24. In a preferred embodiment these could be connecting adhesives such as double sided tape.

Figure 15:
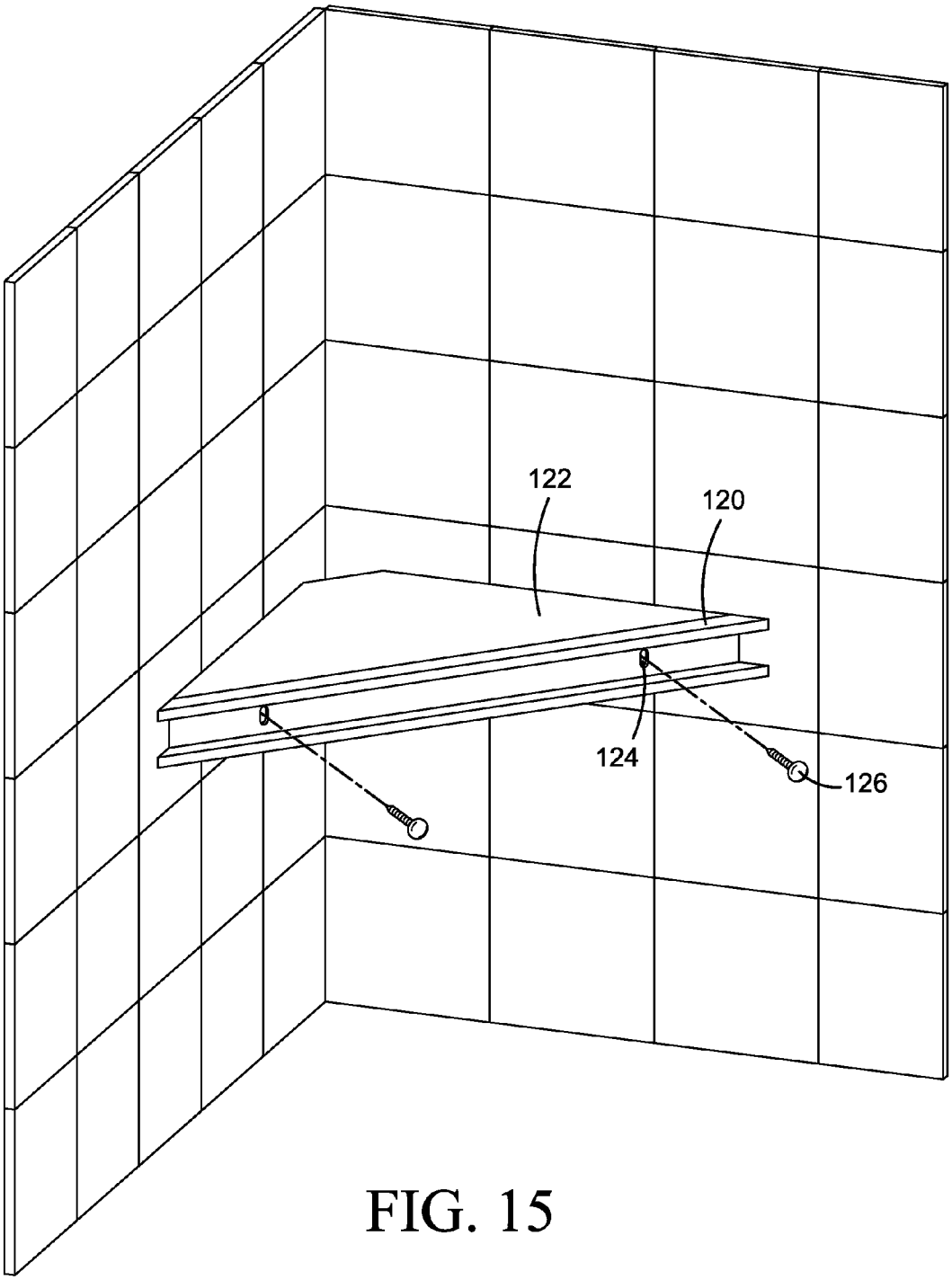
FIG. 15 illustrates a top perspective view of an embodiment of a skeleton shower shelf of an embodiment of the present invention
Figure 16:
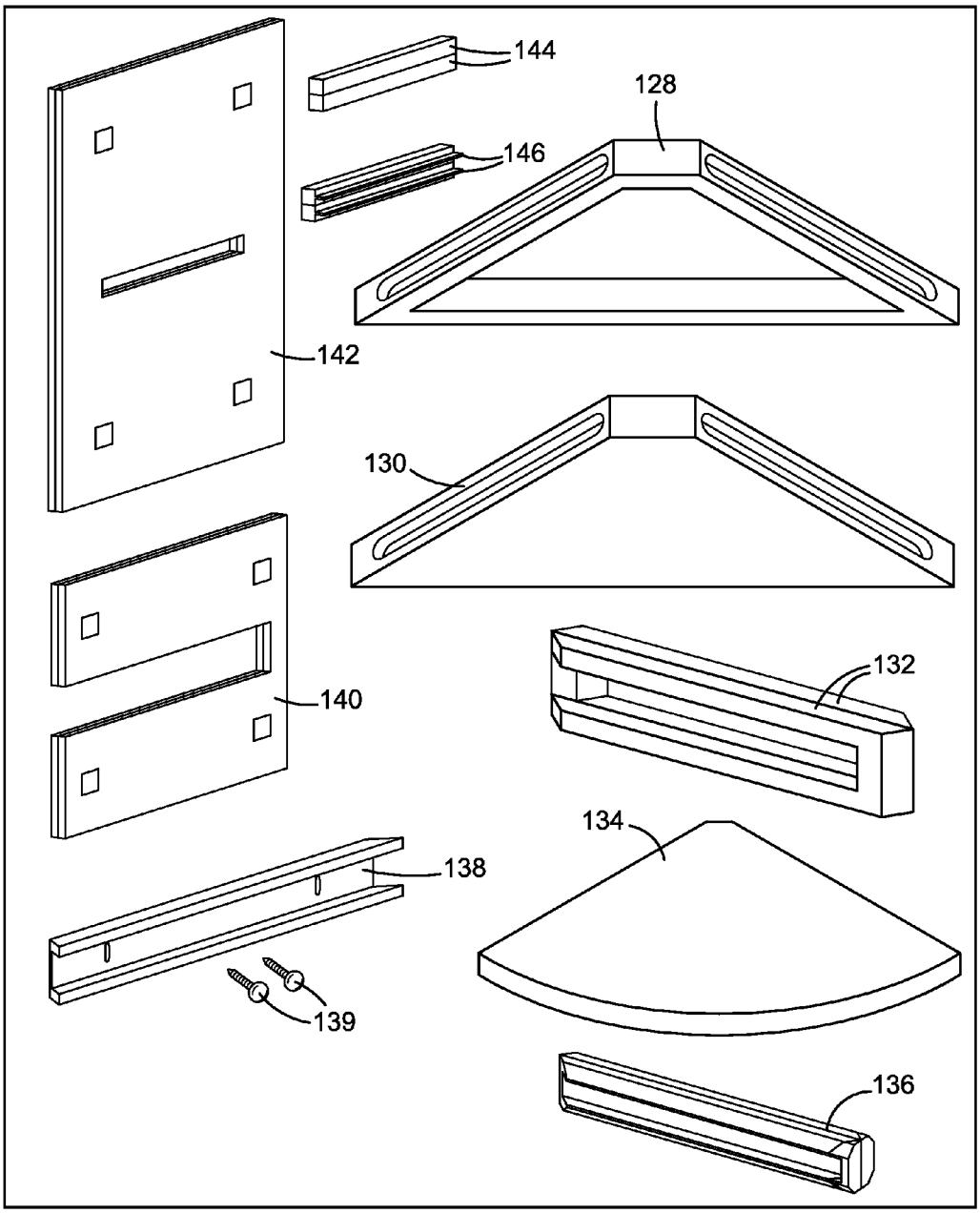
FIG. 16 illustrates pieces of embodiments of the current invention that can be included in a kit.

FIG. 3 illustrates a second embodiment of the jig 26. In the second embodiment the channel section depicted in FIGS. 15 and 16 is located in the elongate opening that provides a mechanism to easily make the channel section properly line up with the wall. In FIG. 3 the channel section 28 or mortise section is attached to the wall utilizing the elongated channel as a guide or jig to the channel section. The jig is first removably adhered to the wall using adhesive patches 30. When the jig is flush with the corner such that angle A is equivalent to angle A depicted in FIG. 8, the installer adheres the jig to the corner. The installer can then guide the section of the device that attaches to the wall through the jig which aligns the section for continued installation. The installer can increase or decrease angle a by rotating the first piece 32 along the center crease or break.

Figure 4:
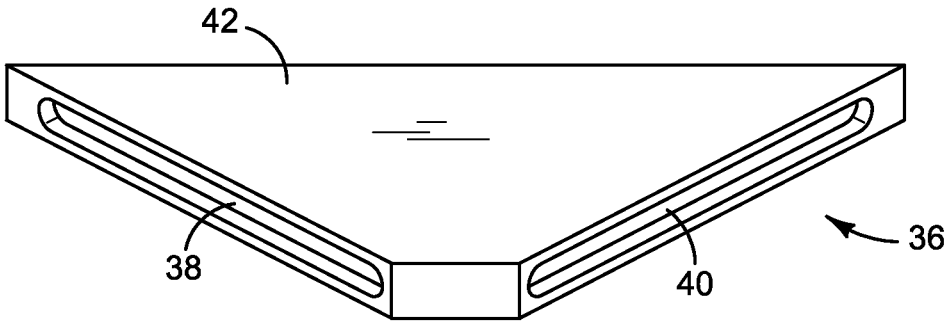
FIG. 4 illustrates a top perspective view of an embodiment of a shower shelf of an embodiment of the present invention.
Figure 5:
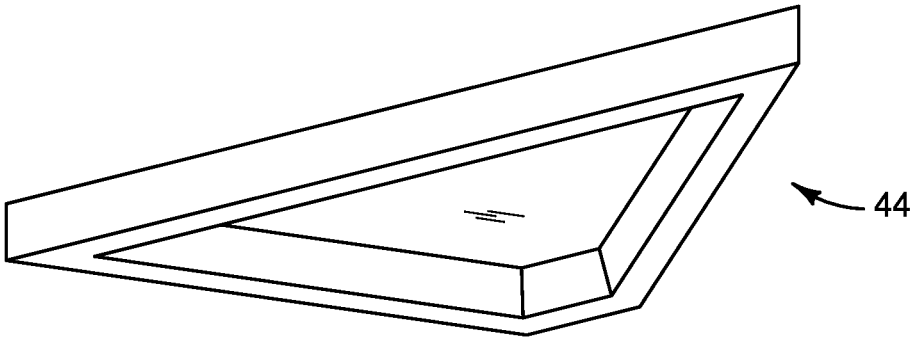
FIG. 5 illustrates a bottom perspective view of an embodiment of a shower shelf of an embodiment of the present invention.
Figure 6:
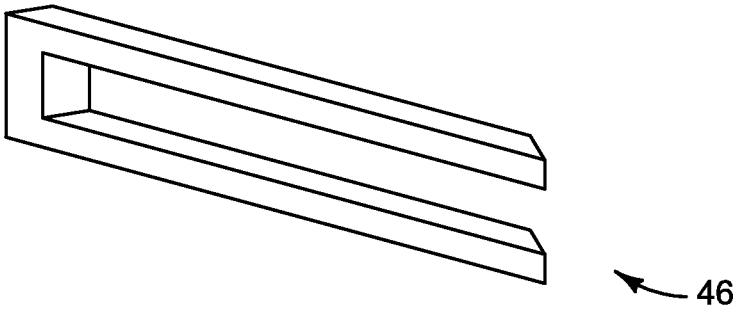
FIG. 6 illustrates an embodiment of a trim unit of an embodiment of the present invention.

FIGS. 4 through 6 depict various embodiments of the shower shelf section. FIGS. 4 and 5 depict a skeleton embodiment 36, 44 in which a user can subsequently tile the shower shelf. FIG. 6 illustrates a solid embodiment, preferably of stone such as granite or marble for installing in the shower. A mortise 38, 40 has been cut or ground into the edges of the shower shelf 42 of FIG. 4 for adhering to a tenon placed on a shower wall. Similarly, FIG. 6 also has a mortise cut or ground into the edges to provide for a tenon. The tenon is attached to the wall and subsequently in a preferred embodiment an adhesive, for example an epoxy, is used to adhere the mortise of the shower shelf to the tenon adhered on the wall.

FIG. 6 illustrates a trim piece 46 that can be included in the kit that is utilized to cover the joint between the shelf and the wall. This is provided predominantly for an aesthetic appearance and is particularly useful for corners that are not perfectly square and have a gap between the shower shelf and the shower wall. The trim piece in FIG. 6 is depicted further in FIG. 12.

FIG. 7 illustrates a shower 68 having jig 49 adhered to shower walls 58, 60. The jig is located in the corner in the shower walls such that the angle A represents the angle of a shower wall. The two sides of the jig fold/bend to align with the walls at the angle A that is present in the shower corner. The jig has two sides 66, 64 that are adhered to the walls 58, 60 of the shower. A first tenon 62 has been installed on the shower wall through the elongate opening 20 of FIG. 2. The second elongate opening 56 is depicted such that a second tenon 50 is placed in to the jig elongate opening 56. Adhesive 52 adheres the tenon to the wall 58 of the shower. The jig allows for ease of installation of the tenons and proper spacing and angle relative to one another and to the corner angle A to provide a base for the shower shelf.

FIG. 8 illustrates two tenons 70, 72 installed in a shower 68 on the shower wall in a corner having angle A. Shower shelf 74 is adhered to the tenons by two mortises (not shown) cut into the edges of the shower shelf. The shower shelf 74 is adhered to the tenons and allowed to dry. FIG. 9 illustrates a view of shower shelf 74 being attached to tenons 72, 70 via an adhesive (not shown).

FIG. 9 illustrates shower shelf 86 attached to shower walls 82, 84 of a shower 78. Angle lines A illustrate the corner of the ideal shower being approximately 90 degrees.

Figure 10:
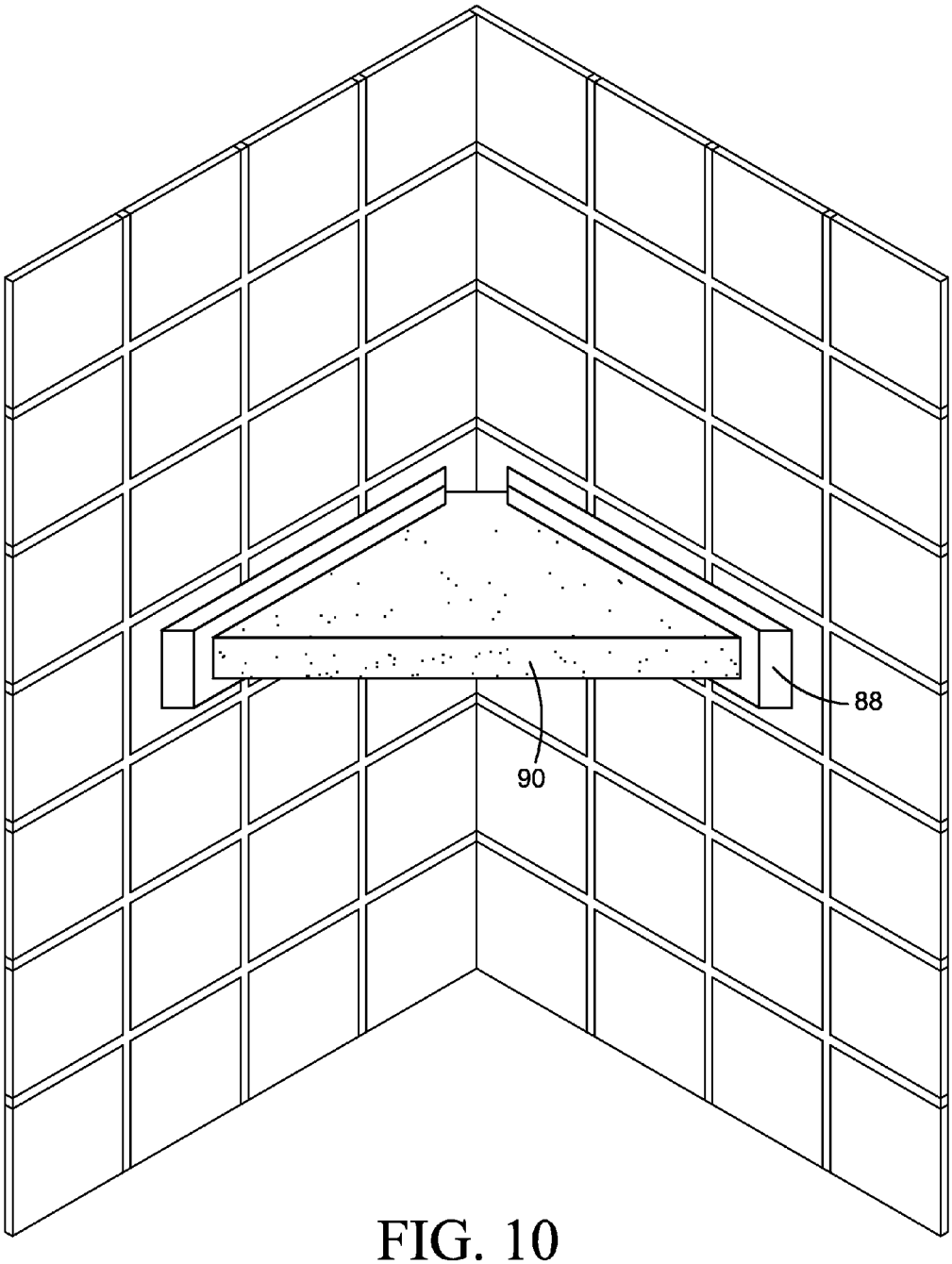
FIG. 10 illustrates an embodiment of a shower shelf of the present invention installed with embodiments of installed with the shower shelf.

FIG. 10 illustrates shower shelf 90 attached to a shower corner formed by two shower walls. Trim pieces 88 (also depicted in FIG. 7) are shown for aesthetic functionality.

Figure 11:
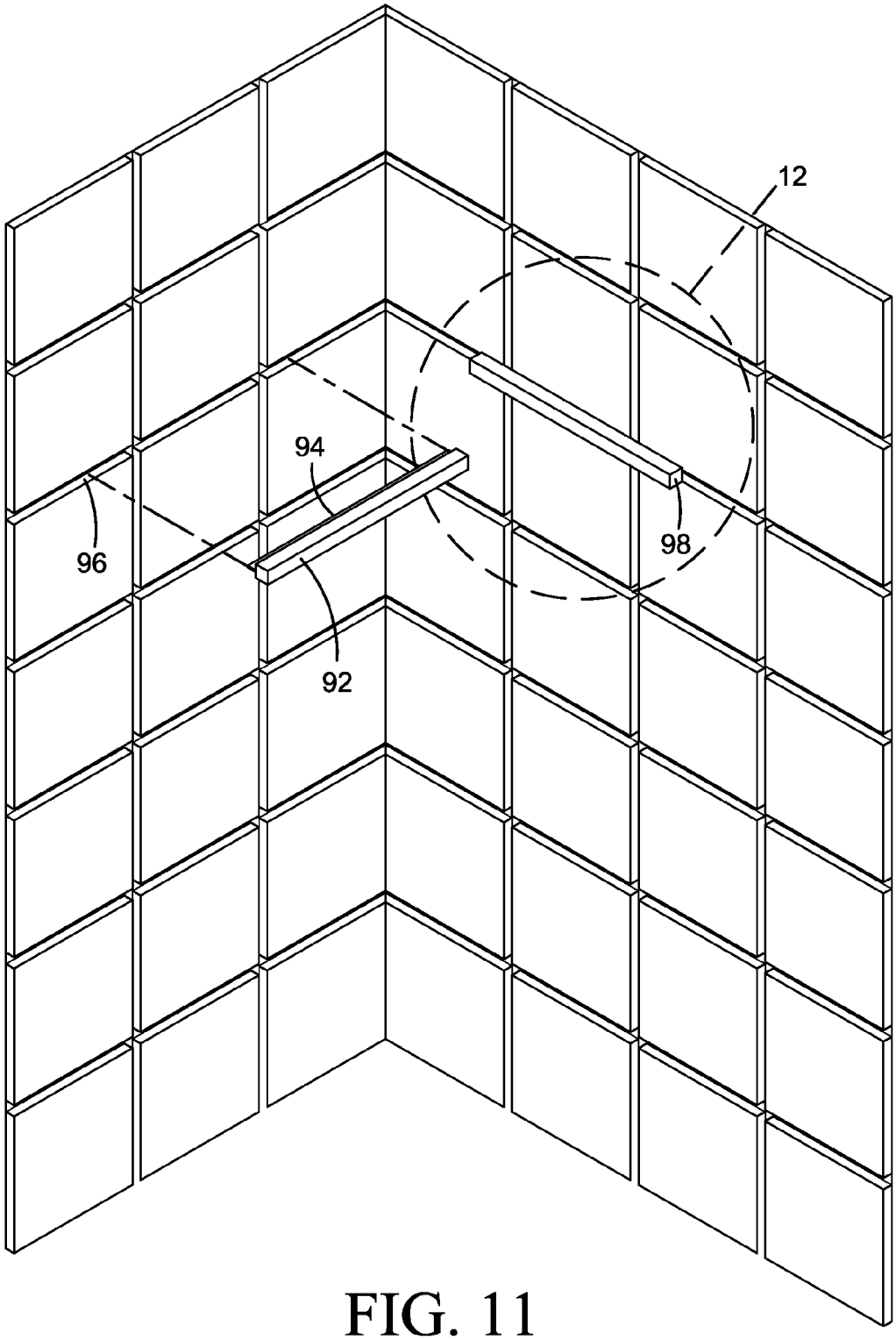
FIG. 11 illustrates a perspective view of a step in a method of installing a shower shelf according to embodiments of the present invention.

FIG. 11 illustrates the potential for utilizing the kit while the shower is being tiled or before the shower has been tiled. While the shower is being tiled, the tenon 98 is placed on top of a tile or row of tiles. Subsequently another tile layer is placed and adhered to the shower wall above the tenon. The tenon ideally has a phalange 94 that is placed on top of the lower level of tile such that the phalange is between two layers of tiles in a groove, illustrated as 96 in FIG. 11. 92 shows an exploded view of tenon 92 with a phalange 94 being installed in grove 96. Tenon 98 is the same as 92, but already installed.

Figure 12:
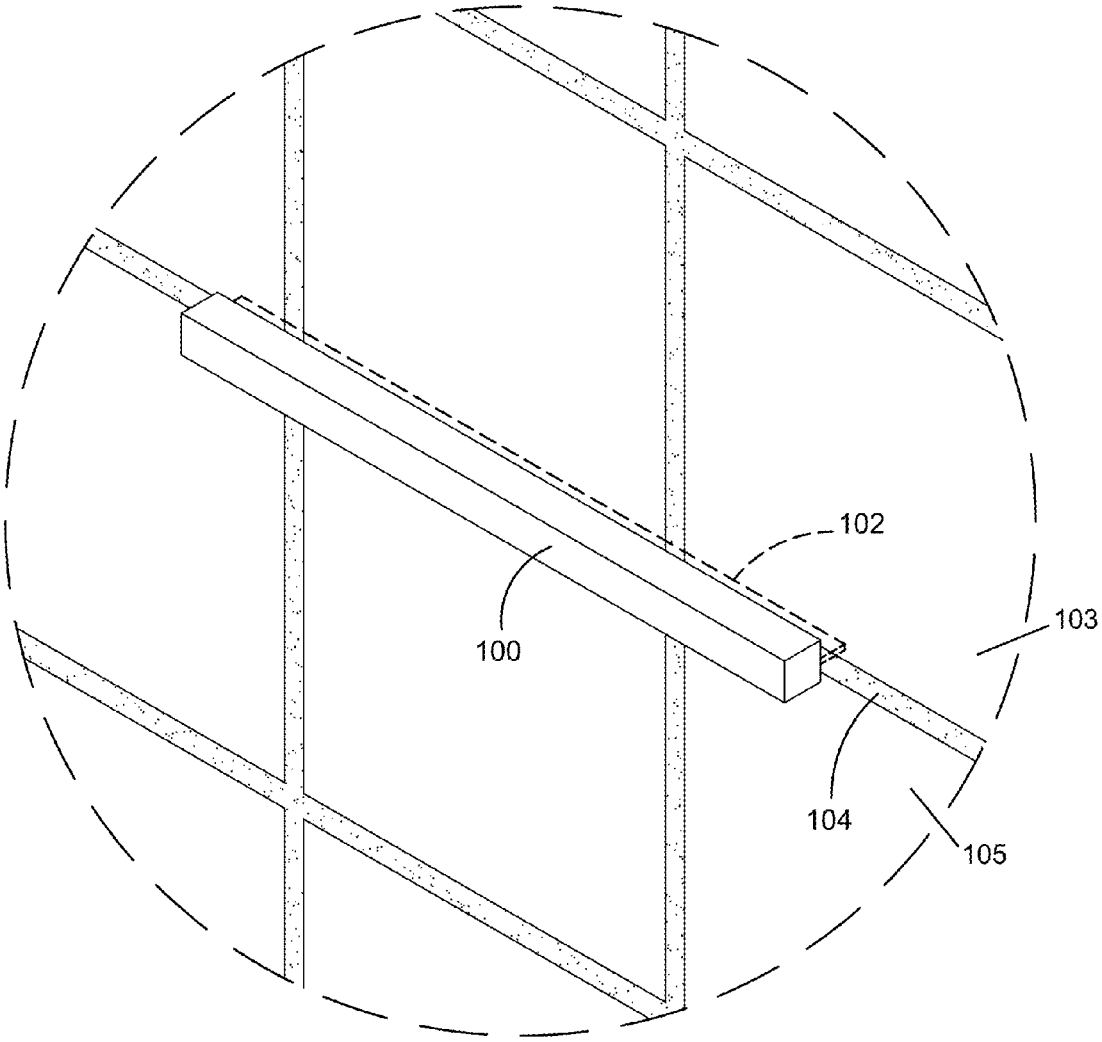
FIG. 12 illustrates a magnified view of an aspect of FIG. 11.

FIG. 12 is a cutout view of circle 12 of FIG. 11. Circle 12 illustrates the phalange 102 attached to tenon 100 located in the groove 104 between the two layers of tile 103, 105.

Figure 13:
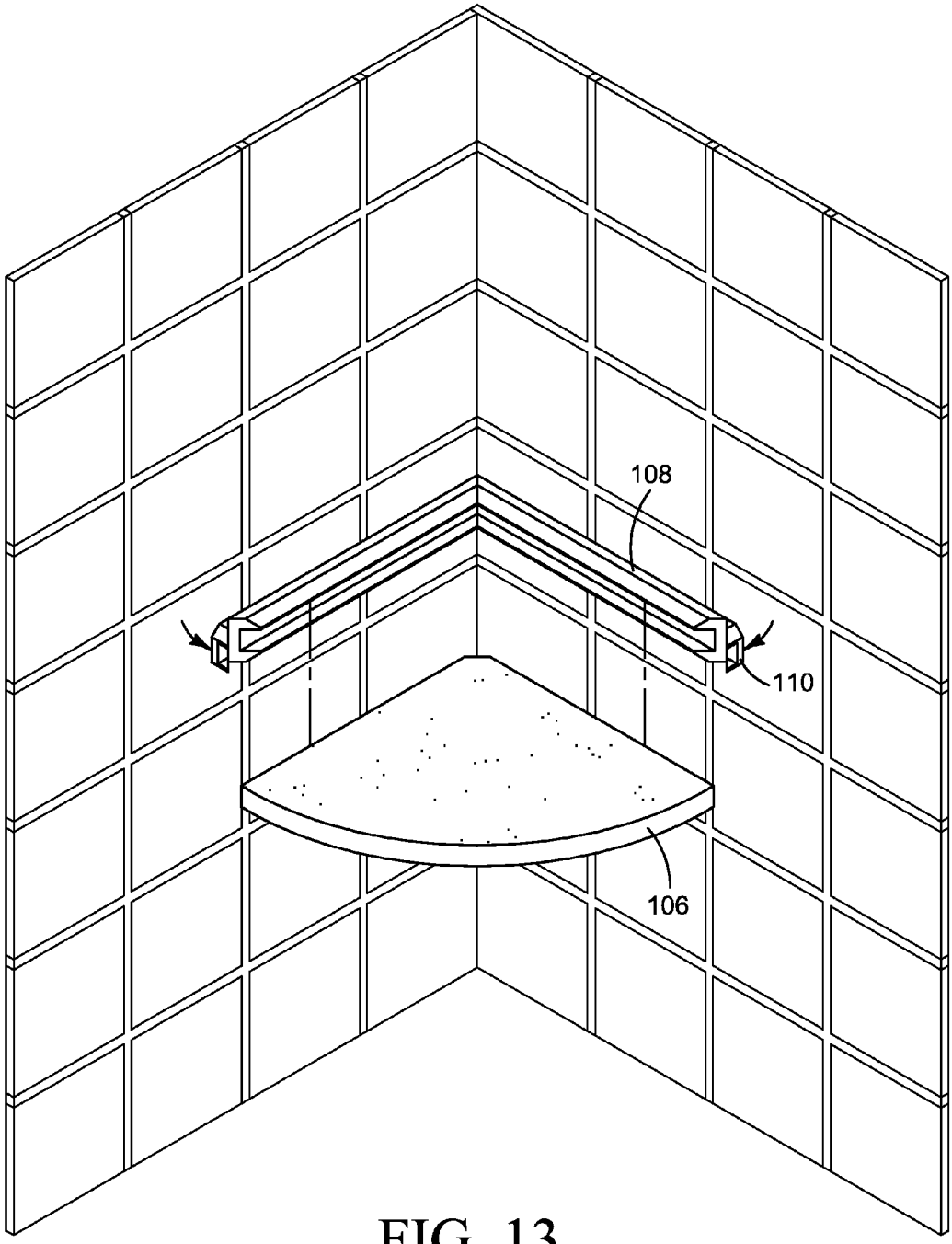
FIG. 13 illustrates a perspective view of a step in a method of installing a shower shelf according to embodiments of the present invention.

FIG. 13 illustrates an alternative embodiment of the invention. In FIG. 13, the mortise section is located in a channel piece 108. This channel piece is adhered to the wall the same way as the alternative embodiment shown in prior figures. The channel piece is positioned on the wall utilizing the jig illustrated in FIG. 3. The channel or mortise section 108 has end pieces 110 that cap the shower shelf into the mortise. These end sections 110 (or caps) are opened and the shower shelf 106 is slid into the channel. The cap sections are subsequently closed. In an ideal mechanism these end pieces snap onto the mortise section.

Figure 14:
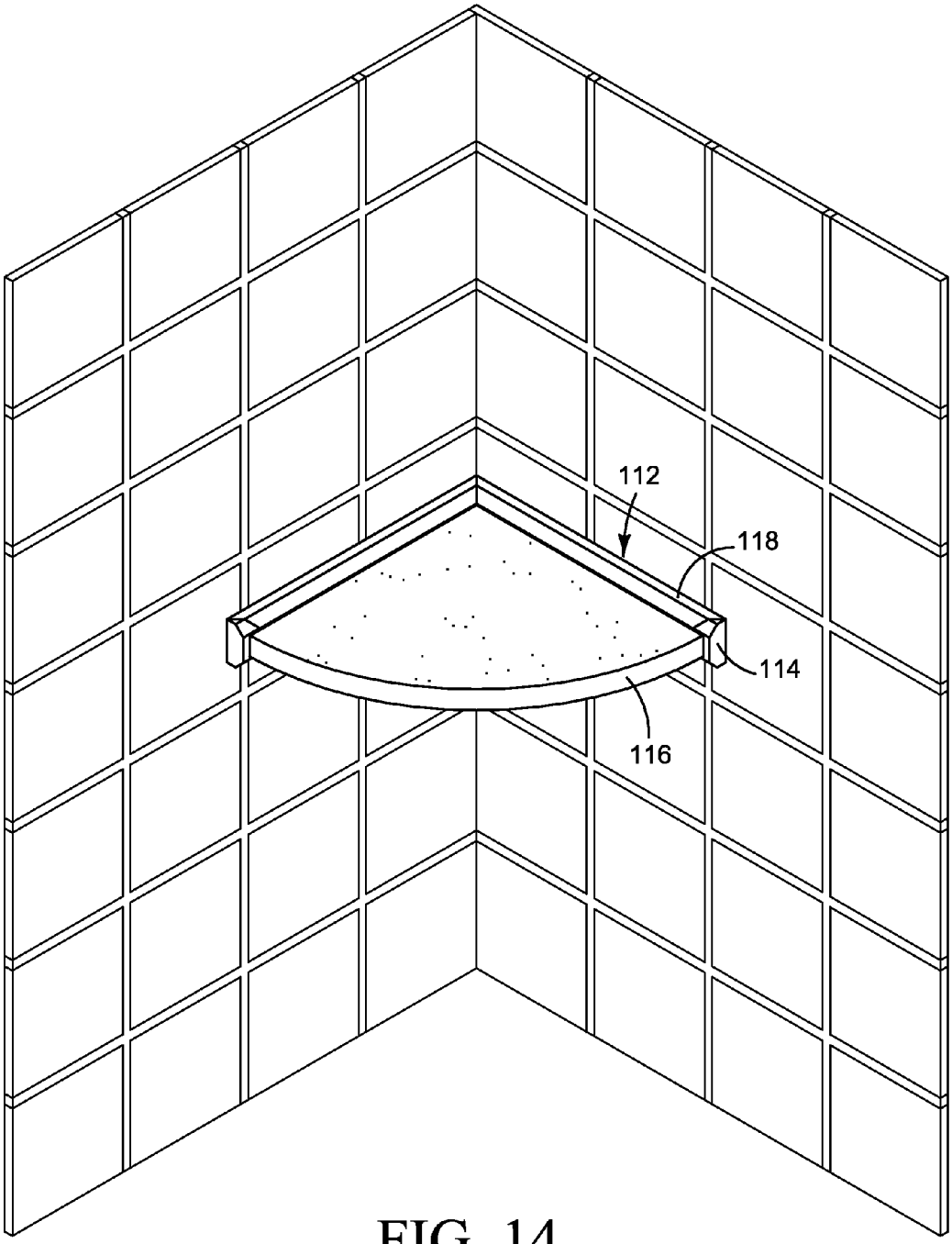
FIG. 14 illustrates a perspective view of a step in a method of installing a shower shelf according to embodiments of the present invention.

FIG. 14 illustrates a view of the alternate embodiment of the invention in which shower shelf 116 is attached to the channel section 118. The assembled unit 112 could then be utilized by the user to place accessories to a shower or bathing situation. End caps 114 are shown in a snapped together or closed position to retain the shower shelf 116 in the channel. In this embodiment, the shower shelf 116 functions as the tenon while the channel section 118 functions as the mortise.

FIG. 15 illustrates an alternative embodiment of the skeleton system. In the alternative embodiment, the skeleton can have a face plate 120 that attaches to the shower shelf 122. The face plate has elongate holes 124 into which a connector 126, such as a screw attaches the face plate to the shower shelf. This allows the face plate to be shifted vertically in order to provide for different angles onto which an installer can install tile onto the shelf. This allows for the face plate and overlapping tile to present different aesthetic views.

FIG. 16 illustrates potential components of a kit that can be sold commercially either to professionals or to DIYers. The kit can come with a variety of these pieces and does not necessarily include all of these pieces. Illustrated in the kit is skeleton shelf 128. Skeleton shelf and alternative embodiment of rock shelf 130 are provided with accompanying tenons or keys 144, 146. These tenons are installed on the shower shelf utilizing jig 142. Accompanying trim pieces 132 can be sold with the shower shelf. A kit can also be provided with or alternatively with the shower shelf 134 and associated jig 140 and channel section 136. This is also depicted in the alternative embodiment of FIGS. 15 and 16. The skeleton shelf 128 can also be provided with face plate 138 and accompanying elongated screws 139. Various embodiments of tenons can be included in the kit including a tenon without a phalange 144 or tenons with a phalange 146.

While certain exemplary embodiments are shown in the figures and described in this disclosure, it is to be distinctly understood that the presently disclosed inventive concept(s) is not limited thereto but may be variously embodied to practice within the scope of the following claims. From the foregoing description, it will be apparent that various changes may be made without departing from the spirit and scope of the disclosure as defined by the following claims.

The invention claimed is:

1. A kit comprised of a series of parts, said parts comprising:

a first piece and a second piece, wherein said first piece comprises a shelf, wherein said first piece and said second piece are configured to connect via at least one mortise and at least one tenon configuration; wherein said second piece is configured to attach to a wall;

a jig, wherein said jig comprises at least one opening slightly larger than said second piece such that said second piece is capable of passing though said jig, said jig comprising two sections, wherein said sections of said jig are configured in a corner shape, wherein said jig is configured to fold generally along an axis, wherein said jig is configured to fold in relation to an angle of a corner in which said jig is placed; and wherein said jig and said second piece are configured such that when said jig is placed in said corner, said opening of said jig is configured to position said second piece through said opening and attach to said corner of said wall such that said second piece is positioned such that when said first piece is attached to said second piece said first piece is oriented to be used as a shelf.

2. The kit of claim 1, wherein said first piece comprises said mortise, wherein said second piece comprises said tenon, wherein said jig is configured such that when said jig is placed in said corner, said opening is aligned such that said tenon is guided through said opening of said jig and positioned on said corner of said wall such that when said shelf is attached to said mortise said shelf is in a generally horizontal position.

3. The kit of claim 2, wherein said kit comprises two of said tenons, wherein said jig comprises two of said openings configured for said tenons to pass through, wherein said two openings in said jig are located on said two sections of said jig, wherein said shelf comprises two of said mortises such that said shelf attaches to said tenons when placed on said adjacent walls of said corner to form a shelf located in said corner.

4. The kit of claim 1, wherein said kit further comprises an adhesive for attaching said second piece to a wall.

5. The kit of claim 1, wherein said kit further comprises an adhesive for attaching said first piece to said second piece.

6. The kit of claim 1, wherein said shelf is a stone shelf.

7. The kit of claim 1, wherein said shelf comprises a shelf configured to be tiled.

8. The kit of claim 1, wherein said jig is configured to removably attach to adjacent walls of a corner.

9. The kit of claim 8, wherein said kit includes a double sided adhesive tape to removably attach said jig to said wall.

10. A method of installing a shower shelf, wherein said method comprises the following steps:

the step of providing a shelf comprising a mortise on two adjacent edges, and a tenon, wherein said tenon is configured to fit within said mortise, and a jig, wherein said jig comprises an opening approximately the size of said tenon wherein said tenon can pass through said opening, wherein said opening is located such that when said jig is positioned in a corner of a wall said opening is aligned such that said tenon is positioned such that when said shelf is attached to said tenon said shelf is in a generally level and useable position;

the step of locating said jig on said corner such that said jig is flush with said corner;

attaching said tenon to said corner by passing said tenon through said opening in said jig and attaching said tenon to said corner;

the step of removing said jig; and the step of attaching said shelf to said tenon by connecting said edges of said shelf comprising said mortise with said tenon.

11. The method of claim 10 wherein said step of attaching said tenon to said corner comprises attaching said tenon to said corner with an adhesive.

12. The method of claim 10 wherein said step of attaching said shelf to said tenon comprises attaching said shelf to said tenon with an adhesive.

13. The method of claim 12 wherein said step of locating said jig to said corner comprises using a double sided adhesive tape to attach said jig to said corner.

14. The method of claim 10 wherein said step of locating said jig in said corner comprises removably attaching said jig to said corner.

15. The method of claim 14 wherein said step of removably attaching said jig to said corner comprises using a double sided adhesive tape to attach said jig to said corner.

16. The method of claim 10, wherein said mortise comprises locks at the ends of said mortise for locking said tenon in place.

17. The method of claim 10 wherein said step of locating said jig in said corner comprises removably attaching said jig to said corner.

18. A method of installing a shower shelf, wherein said method comprises the following steps:

the step of providing a shelf, wherein said shelf comprising a tenon on adjacent edges, and a piece comprising a mortise, wherein said tenon is configured to fit within said mortise, and a jig, wherein said jig comprises an opening approximately the size of said piece comprising said mortise wherein said piece comprising said mortise can pass through said opening, wherein said opening is located such that when said jig is positioned in a corner of a wall said opening is aligned such that when said piece comprising said mortise is positioned such that when said shelf is attached to said piece said shelf is in a generally level and useable position;

the step of locating said jig on a wall corner such that said jig is flush with said wall corner;

the step of attaching said piece comprising said mortise to said corner by passing said piece comprising said mortise through said opening in said jig and attaching said mortise to said corner;

the step of removing said jig; and the step of attaching said shelf to said piece comprising said mortise by connecting said edges of said shelf comprising said tenon with said piece comprising said mortise.

19. The method of claim 18 wherein said step of attaching said piece comprising said mortise to said corner comprises attaching said piece comprising said mortise to said corner with an adhesive.

20. The method of claim 18 wherein said step of attaching said shelf to said piece comprising said mortise comprises attaching said shelf to said piece comprising said mortise with an adhesive.

* * * * *